US005927109A

United States Patent [19]

Sieck

[11] Patent Number: 5,927,109

[45] Date of Patent: Jul. 27, 1999

[54] LADDER LOCKING MEANS

[76] Inventor: Hugh H. Sieck, 6701 Hawkins Bend, Lincoln, Nebr. 68516

[21] Appl. No.: 09/064,215

[22] Filed: Apr. 22, 1998

[51] Int. Cl.[6] ..... E05B 69/00

[52] U.S. Cl. ..... 70/58; 70/18; 70/63; 182/230

[58] Field of Search ..... 70/14, 18, 19, 70/57, 58, 63; 182/207, 213, 214, 230, 121, 129

[56] References Cited

U.S. PATENT DOCUMENTS

| | | | |
|---|---|---|---|
| D. 244,346 | 5/1977 | Conners | D8/339 |
| D. 356,166 | 3/1995 | Spiller | D25/68 |
| 2,130,216 | 9/1938 | Zaninovich | 292/259 |
| 2,755,748 | 7/1956 | Abell, Jr. | 70/63 X |
| 3,110,506 | 11/1963 | O'Brien | 280/179 |
| 3,727,438 | 4/1973 | Knaack | 70/63 |
| 4,212,371 | 7/1980 | Gaviorno, Jr. | 182/121 |
| 4,440,263 | 4/1984 | Smith | 182/121 |
| 4,450,937 | 5/1984 | Broughton | 182/206 |
| 4,474,116 | 10/1984 | Castenada, Jr. et al. | 70/63 X |
| 4,924,971 | 5/1990 | Rice | 182/93 |
| 4,936,416 | 6/1990 | Garon | 182/187 |
| 5,010,979 | 4/1991 | Shreve, III | 182/214 |
| 5,239,849 | 8/1993 | Gallardo | 70/63 X |
| 5,281,063 | 1/1994 | Austin, III | 410/151 |
| 5,299,721 | 4/1994 | Cummings | 70/58 X |
| 5,441,126 | 8/1995 | Orrick | 182/106 |
| 5,582,269 | 12/1996 | Gugel et al. | 182/129 |
| 5,595,073 | 1/1997 | Sullivan | 70/58 X |
| 5,687,701 | 11/1997 | Henry | 70/58 X |
| 5,832,755 | 11/1998 | Crilly | 70/19 X |

FOREIGN PATENT DOCUMENTS

| | | | |
|---|---|---|---|
| 1032781 | 7/1953 | France | 70/69 X |
| 2681823 | 4/1993 | France | 70/19 |
| 2125094 | 2/1984 | United Kingdom | 70/19 |

*Primary Examiner*—Suzanne Dino Barrett
*Attorney, Agent, or Firm*—Zarley, McKee, Thomte, Voorhees & Sease; Dennis L. Thomte

[57] ABSTRACT

A locking device is provided for preventing the theft of a ladder from a job site and is used in combination with a tool storage chest or tool box. First and second locking members are extended through opposite sides of the tool box with one of the locking members passing through a ladder positioned adjacent the tool box. The inner ends of the first and second locking members telescopically receive one another and a locking pin extends through the telescoping inner ends to secure the ladder in place. When the access door to the tool box is locked, access to the locking pin is prevented.

10 Claims, 5 Drawing Sheets

LADDER LOCKING MEANS

BACKGROUND OF THE INVENTION

1. Field of the Invention

This invention relates to a ladder locking means and more particularly to a means for locking a ladder to a tool chest which is left at a job site.

2. Description of the Related Art

Job site tool boxes are frequently used at construction job sites for overnight storage of tools. The tool boxes, sometimes called tool chests, are necessary to keep the tools safe overnight, since there is a large amount of theft on job sites. The tool boxes are locked and are fairly secure. Normally, on those job sites, ladders are also used and they are frequently chained to the tool box or to some building structure to prevent the theft thereof. However, thieves can easily cut the chains with bolt cutters or the like.

SUMMARY OF THE INVENTION

A means is provided for preventing the theft of a ladder from a job site and is used in combination with a tool storage chest including a bottom wall, a top wall, a back wall, opposite site walls and a front wall, with one of the walls of the chest having a locking access door to provide access to the interior thereof. A first locking member, having inner and outer ends, extends through a ladder positioned adjacent the chest and through one of the side walls thereof into the interior of the chest. A second locking member, having inner and outer ends, extends through the opposite wall of the chest and into the interior of the chest. The inner ends of the first and second locking members telescopically receive one another and a locking means in the form of a pin extends through the telescoping locking members to prevent the removal of the ladder from the position adjacent the tool chest unless access is gained to the interior of the tool chest to remove the pin. The outer ends of the first and second locking means comprise flat plates which have a configuration to prevent the separation of the ladder therefrom.

It is therefore a principal object of the invention to provide a means for preventing the theft of a ladder from a job site.

A further object of the invention is to provide a mean for preventing the theft of a ladder from a job site wherein first and second locking means extend into the sides of a tool chest with the telescoping inner ends thereof being secured by a locking means so that the ladder may not be removed from the position adjacent the tool chest.

Still another object of the invention is to provide a means for preventing the theft of a ladder from a job site which may be used in combination with a tool job site storage chest.

Still another object of the invention is to provide a means for preventing the theft of a ladder from a job site which does not require extensive modification of the tool chest being utilized therewith.

Still another object of the invention is to provide a means for preventing the theft of a ladder from a job site which is economical of manufacture, durable in use and refined in appearance.

These and other objects will be obvious to those skilled in the art.

DESCRIPTION OF THE PREFERRED EMBODIMENT

Figure 1:
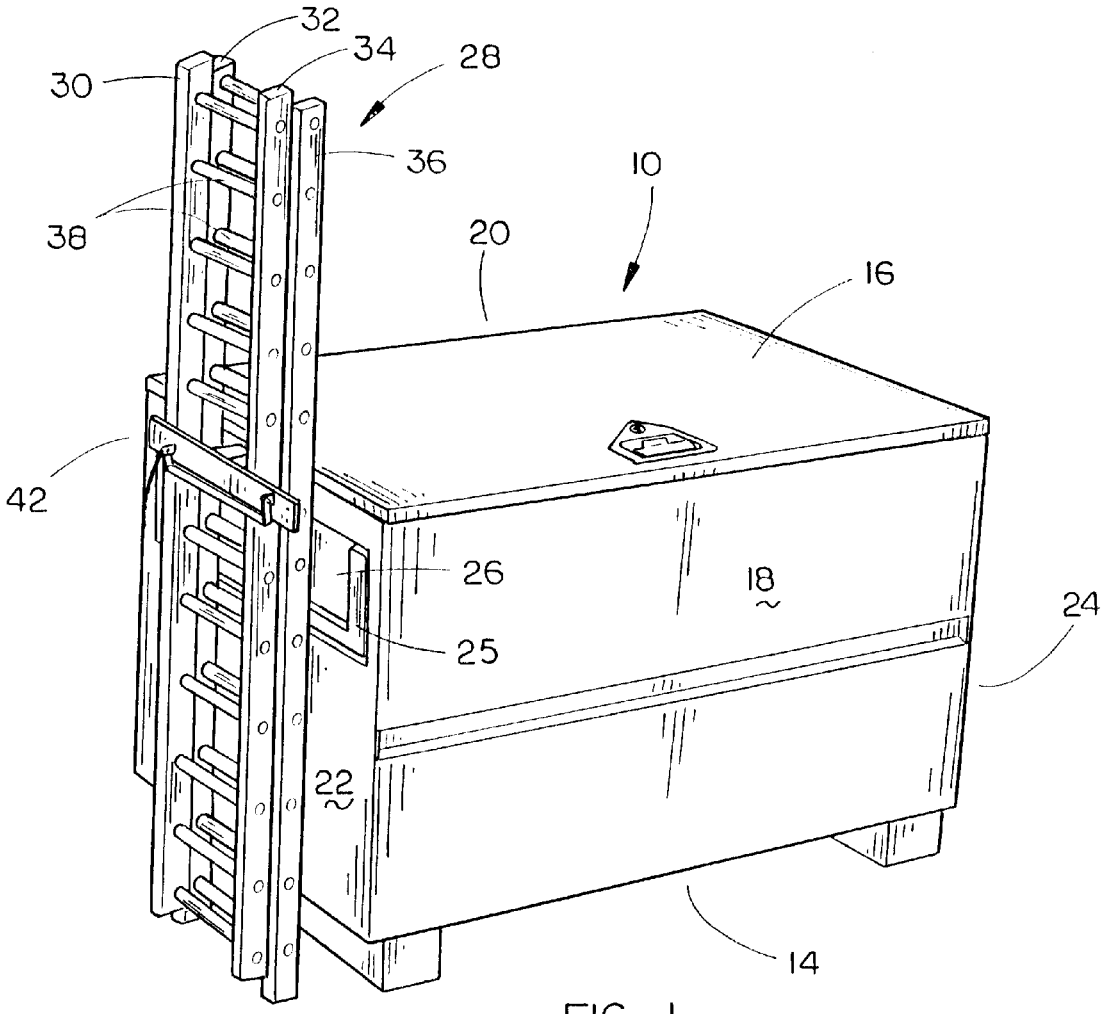
FIG. 1 is a perspective view of the ladder locking means of this invention.
Figure 2:
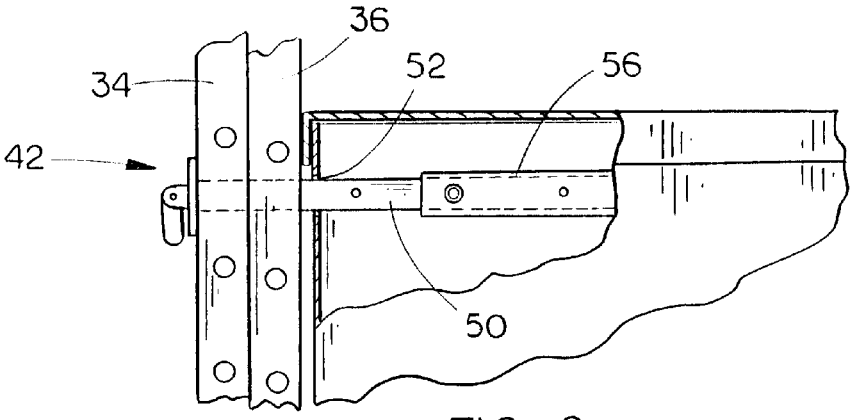
FIG. 2 is a partial sectional view illustrating the manner in which the locking means extends through the tool box.
Figure 3:
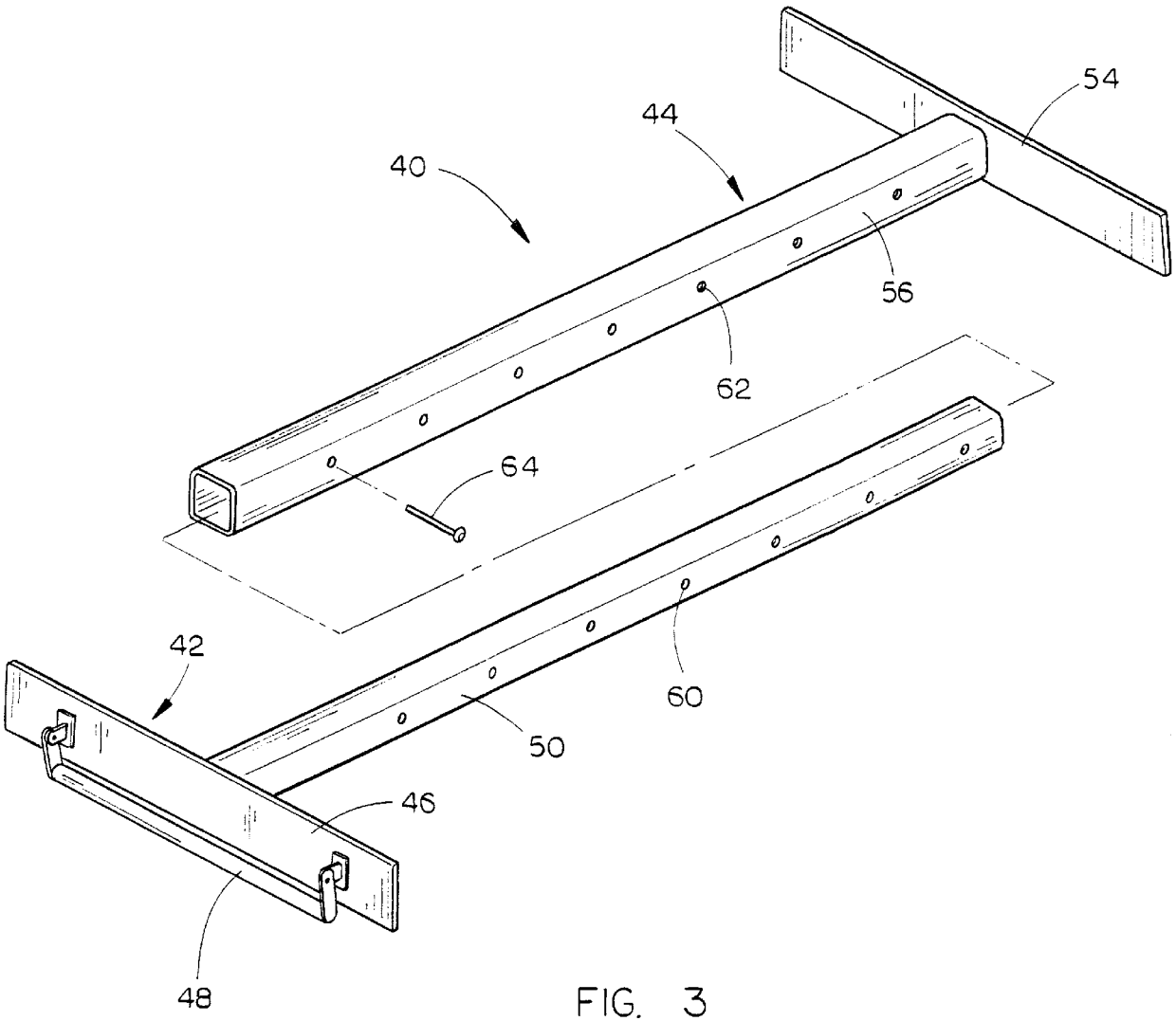
FIG. 3 is a perspective view of the ladder locking means of this invention.
Figure 4:
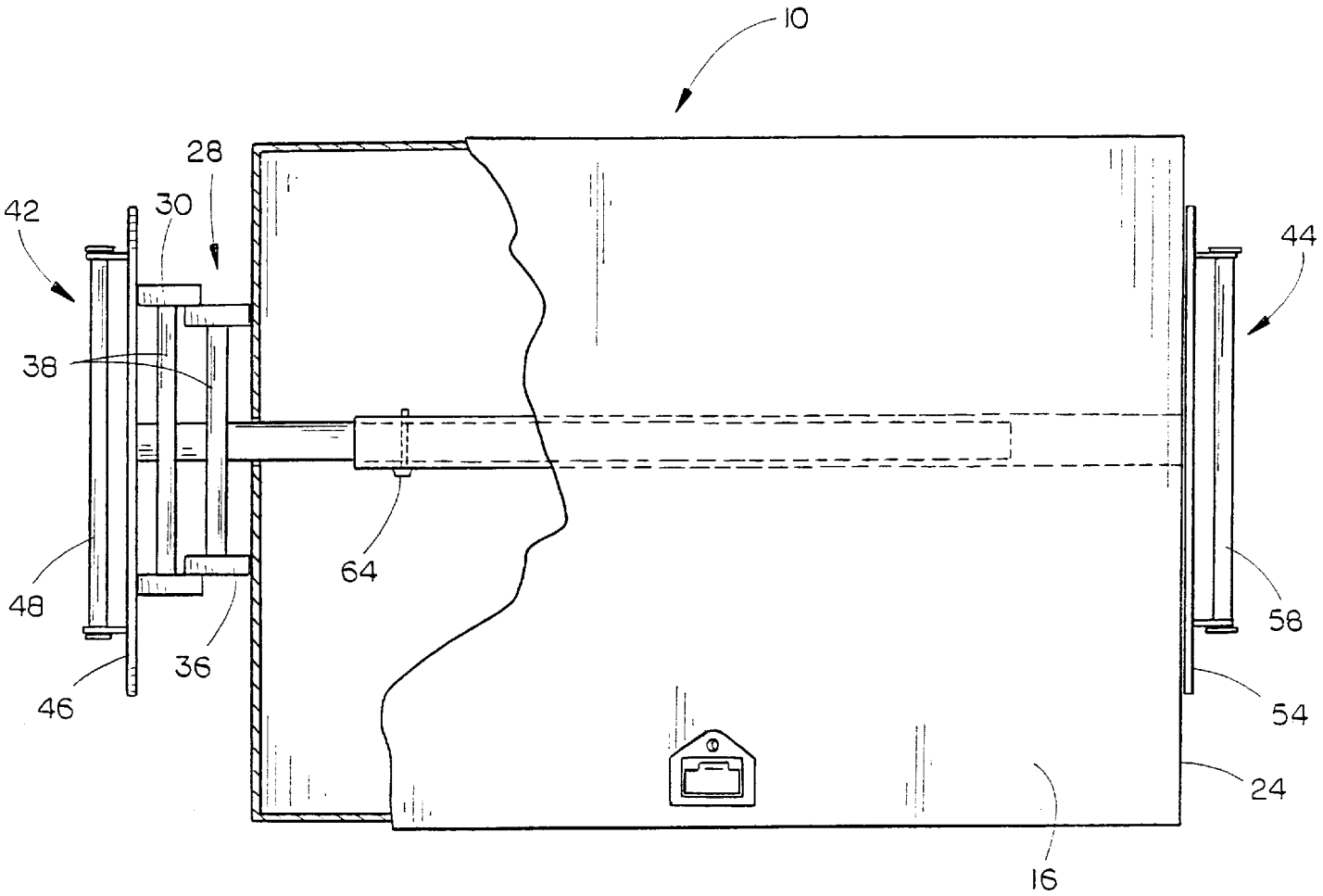
FIG. 4 is a top elevational view of a tool box having the ladder locking means of this invention being utilized therewith.

The numeral 10 refers to a job site tool box or tool chest which may take many shapes and forms. However, all of the tool boxes include a bottom wall 14, top wall 16, front wall 18, back wall 20 and opposite side walls 22 and 24. Normally, access to the interior of the tool box or tool chest is gained by providing a locking door placed either in the front wall of the tool box or in the top wall of the tool box. Further, many of the tool boxes have a recess 26 formed in each of the side walls thereof where a pivotal handle 25 is located.

The numeral 28 refers to a conventional ladder which may be either of the folding type or of the extension type. In either case, the ladder 28 will include legs 30, 32, 34 and 36 as well as steps or rungs 38.

The preferred embodiment of the ladder locking means is referred to generally by the reference numeral 40 and preferably comprises first and second locking members 42 and 44. Locking member 42 comprises an outer end 46 which is in the shape of a flat, rectangular member preferably having a handle 48 pivotally secured to the exterior surface thereof. A tubular member 50 is secured to the inner surface of plate 46 and extends inwardly therefrom through a suitable opening 52 formed in the side 22 of the tool box. The second locking member 44 likewise comprises an outer end 54 which is in the form of a flat, rectangular plate having a tubular member 56 secured thereto which extends inwardly therefrom through an opening formed in the side wall of the tool box. Handle 58 is pivotally secured to plate 54. Tubular members 50 and 56 are provided with spaced-apart openings 60 and 62 formed therein, respectively. While it is described that the tubular members 42 and 46 extend inwardly through the side walls 22 and 24 of the tool box, it is conceivable that the tubular members could also extend through the front and rear walls of the tool box, if so desired. At any rate, tubular member 50 is telescopically received by tubular member 56 with the openings 60 and 62 to receive a locking pin 64.

While it has been illustrated that the tubular members 50 and 56 extend through openings formed in the side walls of the tool chest at a location above the recessed areas 26, if desired, the handles 25 on opposite sides of the tool box may be removed with openings being formed in the recessed areas 26 so that the tubular members 50 and 56 will extend through the recessed areas 26. Thus, when a ladder is not being locked in place adjacent the tool box, the outer ends 46 and 34 of the locking means 42 and 44, respectively, will be positioned in the recessed areas 26 with the handles 48 and 58 serving as the handles for the tool box.

When it is desired to lock a ladder 28 to the tool box 10, the ladder 28 is positioned adjacent one of the side walls of the tool box in either a vertically disposed condition or a horizontally disposed condition. Assuming that it is desired to position the ladder 28 adjacent side wall 22, the tubular member of locking member 34 is extended through the ladder 28, between rungs 38 and the legs thereof, and into the interior of the tool box until the flat plate 46 is positioned closely adjacent the exterior surface of the ladder, as seen in FIG. 1. Tubular member 56 of locking member 44 is extended through a suitable opening in the side wall 24 of the tool box and telescopically receives the tubular member 50, as previously described. The locking pin 64 is then extended through the openings 60 and 62 of tubular members 50 and 56. When the tubular members 50 and 56 have been secured together by the locking pin 64, the ladder 28 cannot be removed from its position adjacent the tool box due to the configuration of the plate 46.

Thus, when the ladder is locked in place at the end of a work day and the tool box is locked, the access door on the tool box must be "peeled" in an effort to gain access to the locking pin 64. The configuration of the locking members 42 and 44 is such that it would be practically impossible to cut the same, while the ladder 28 is in place, to enable the ladder 28 to be removed. At any rate, the destruction of the locking means 40, in an effort to steal the ladder 28, would take a fairly long period of time, which would certainly be a deterrent to the theft of the ladder.

Figure 5:
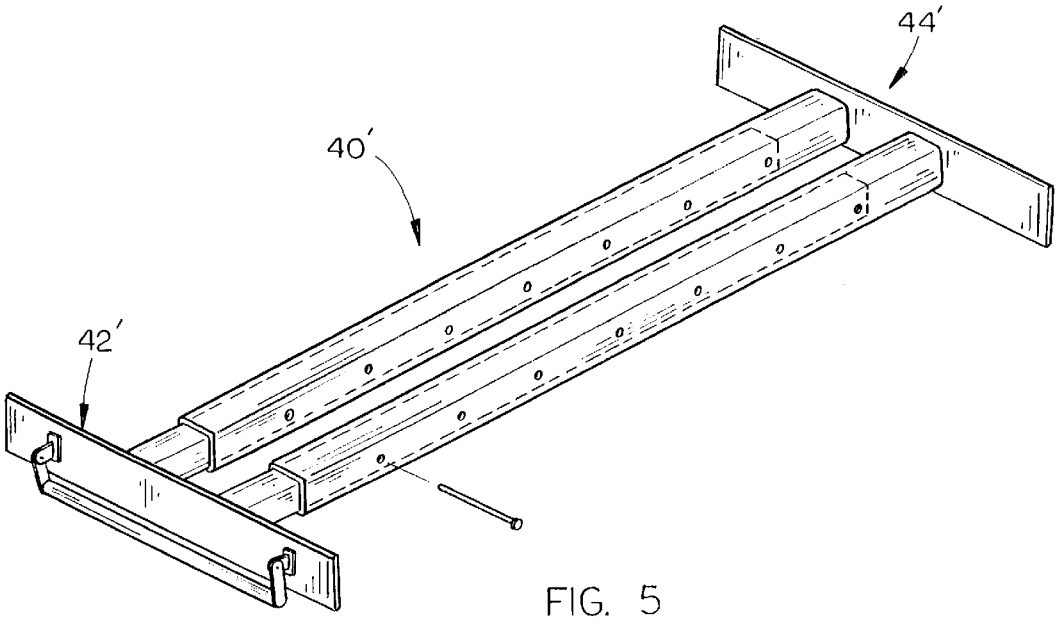
FIG. 5 is a perspective view of a modified form of the invention.
Figure 6:
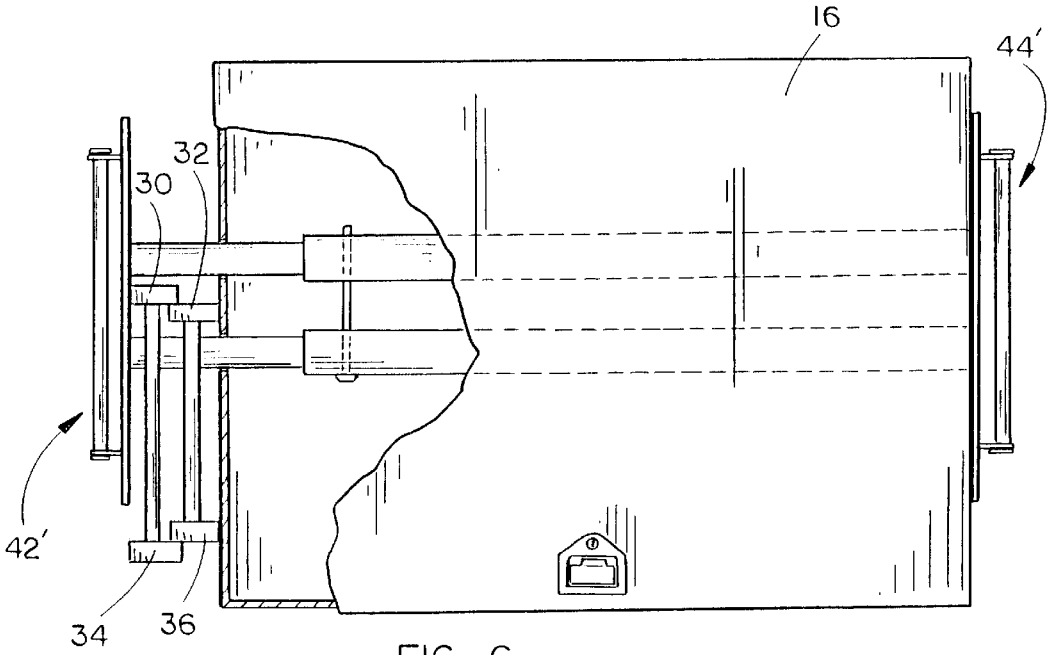
FIG. 6 is a view similar to FIG. 4 except that the modified form of the invention of FIG. 5 is illustrated.
Figure 7:
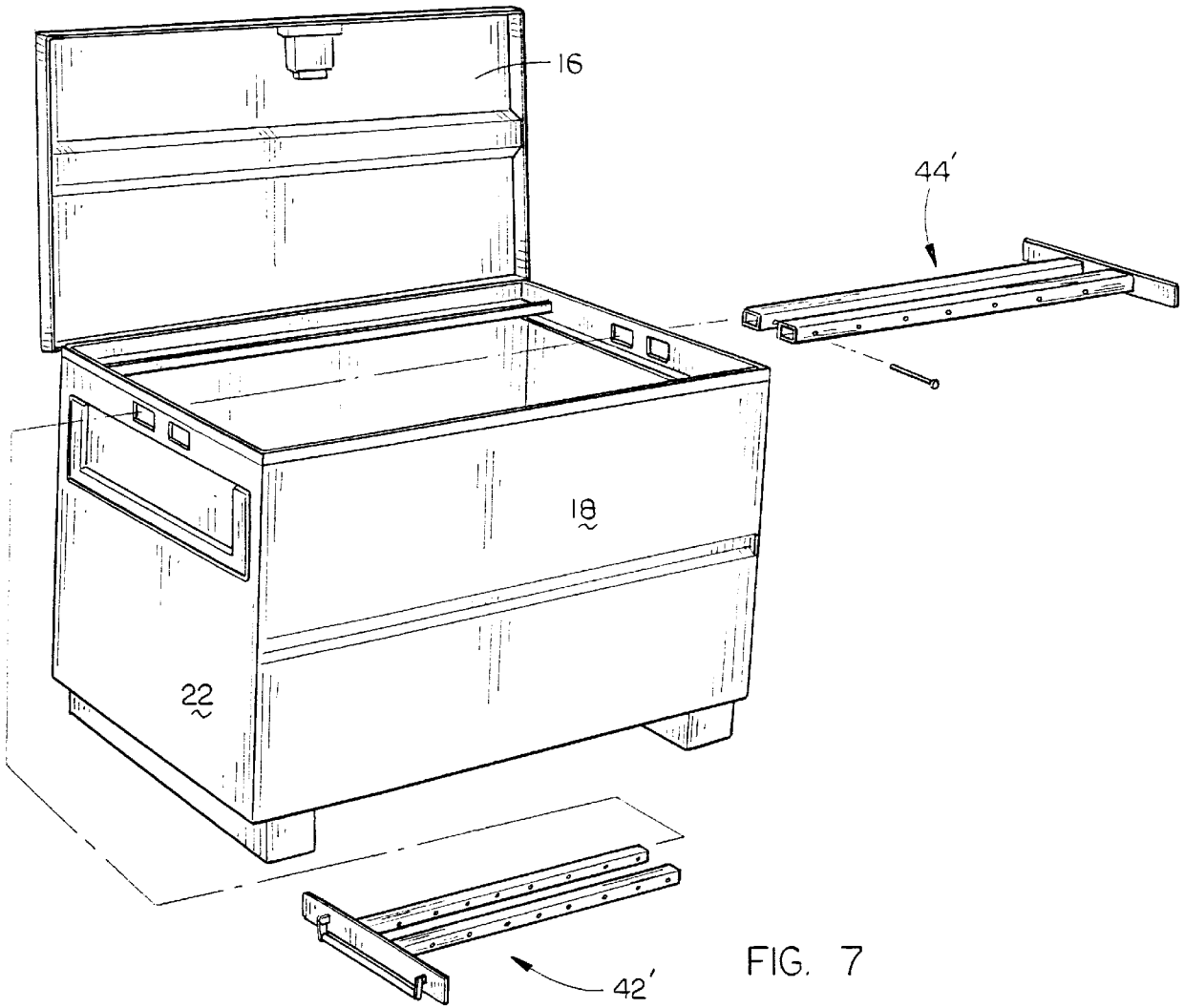
FIG. 7 is a perspective view illustrating the manner in which the embodiment of FIG. 5 is utilized with a tool box.

FIGS. 5–7 illustrate a modified form of the invention and which is referred to generally by the reference numeral 40'. The only difference between the locking means 40' and locking means 40 is that each of the locking members 42' and 44' have a pair of tubular members rather than a single tubular member. By utilizing a pair of tubular members on each of the locking members 42' and 44', the legs at one side of the ladder, for example legs 30 and 32, may be positioned between the pair of tubular members, as illustrated in FIG. 6, which gives further security to the device.

Thus it can be seen that the invention accomplishes at least all of its stated objectives.

I claim:

1. A means for preventing the theft of a ladder from a job site, comprising:

a tool storage chest including a bottom wall, a top wall, a back wall, opposite side walls, and a front wall;

one of said walls of said chest having an access door providing access to the interior thereof;

a rigid first locking member, having inner and outer ends, extending through a ladder positioned adjacent said chest and through one of said walls into the interior of said chest;

locking means in said chest in engagement with said first locking member for preventing said first locking member from being withdrawn from said chest, said locking means being movable between locked and unlocked positions;

said outer end of said first locking member having a configuration so as to prevent the removal of the ladder from adjacent said chest unless said locking means is unlocked.

2. The structure of claim 1 wherein said outer end of said first locking member has a discrete handle provided thereon.

3. A means for preventing the theft of a ladder from a job site, comprising:

a tool storage chest including a bottom wall, a top wall, a back wall, opposite side walls, and a front wall;

one of said walls of said chest having an access door providing access to the interior thereof;

a first locking member, having inner and outer ends, extending through a ladder positioned adjacent said chest and through one of said walls into the interior of said chest;

locking means in said chest in engagement with said first locking member for preventing said first locking member from being withdrawn from said chest, said locking means being movable between locked and unlocked positions;

said outer end of said first locking member having a configuration so as to prevent the removal of the ladder from adjacent said chest unless said locking means is unlocked; and a second locking member, having inner and outer ends, extending into said chest through another wall, for engagement with said inner end of said first locking member, said locking means engaging said inner ends of said first and second locking members.

4. The structure of claim 3 wherein said inner end of said first locking member telescopically receives said inner end of said second locking member and wherein said locking means comprises a pin means selectively extending through said inner ends of said first and second locking members.

5. The structure of claim 3 wherein said first locking member extends through one of said side walls and wherein said second locking member extends through the other of said side walls.

6. A means for preventing the theft of a ladder from a job site, comprising:

a tool storage chest including a bottom wall, a top wall, a back wall, opposite side walls, and a front wall;

one of said walls of said chest having an access door providing access to the interior thereof;

first locking member, having inner and outer ends, extending through a ladder positioned adjacent said chest and through one of said walls into the interior of said chest;

locking means in said chest in engagement with said first locking member for preventing said first locking member from being withdrawn from said chest, said locking means being movable between locked and unlocked positions;

said outer end of said first locking member having a configuration so as to prevent the removal of the ladder from adjacent said chest unless said locking means is unlocked;

said outer end of said first locking member comprising a flat, rectangular plate; and a tubular member secured to said flat plate and extending inwardly therefrom into the interior of the chest.

7. The structure of claim 6 wherein second locking member, having inner and outer ends, extends into said chest through another wall, for engagement with said inner end of said first locking member, said locking means engaging said inner ends of said first and second locking members.

8. The structure of claim 7 wherein said inner end of said first locking member telescopically receives said inner end of said second locking member and wherein said locking means comprises a pin means selectively extending through said inner ends of said first and second locking members.

9. The structure of claim 6 wherein a pair of spaced-apart tubular members are secured to said plate and extend into said chest.

10. A means for preventing the theft of a ladder from a job site, comprising:

a tool storage chest including a bottom wall, a top wall, a back wall, opposite side walls, and a front wall;

one of said walls of said chest having an access door providing access to the interior thereof;

a first locking member, having inner and outer ends, extending through a ladder positioned adjacent said chest and through one of said walls into the interior of said chest;

locking means in said chest in engagement with said first locking member for preventing said first locking member from being withdrawn from said chest, said locking means being movable between locked and unlocked positions;

said outer end of said first locking member having a configuration so as to prevent the removal of the ladder from adjacent said chest unless said locking means is unlocked;

said first locking member comprising a generally U-shaped member including said outer end and a pair of spaced-apart tubular members extending therefrom into said chest.

* * * * *